US010427440B2

(12) United States Patent
Guzzo

(10) Patent No.: US 10,427,440 B2
(45) Date of Patent: Oct. 1, 2019

(54) SYSTEMS AND METHODS FOR IMPROVING COLOR IMAGING AND PRINT HEAD ALIGNMENT, COORDINATION, REGISTRATION AND/OR RE-REGISTRATION

(71) Applicant: VIRTUAL GRAPHICS, LLC, Easton, PA (US)

(72) Inventor: John V. Guzzo, Easton, PA (US)

(73) Assignee: VIRTUAL GRAPHICS, LLC, Easton, PA (US)

( * ) Notice: Subject to any disclaimer, the term of this patent is extended or adjusted under 35 U.S.C. 154(b) by 0 days.

(21) Appl. No.: 16/067,386

(22) PCT Filed: Jun. 21, 2017

(86) PCT No.: PCT/US2017/038541
§ 371 (c)(1),
(2) Date: Jun. 29, 2018

(87) PCT Pub. No.: WO2017/223198
PCT Pub. Date: Dec. 28, 2017

(65) Prior Publication Data

US 2019/0111719 A1 Apr. 18, 2019

Related U.S. Application Data

(60) Provisional application No. 62/352,853, filed on Jun. 21, 2016.

(51) Int. Cl.
*B41J 2/32* (2006.01)
*B41J 2/315* (2006.01)
(Continued)

(52) U.S. Cl.
CPC ..... *B41M 5/36* (2013.01); *B41J 2/315* (2013.01); *B41J 2/32* (2013.01); *B41M 5/124* (2013.01);
(Continued)

(58) Field of Classification Search
CPC ... B41J 2/32; B41J 2/315; B41M 5/34; B41M 5/36; B41M 5/42; B41M 5/124; G09F 3/10
See application file for complete search history.

(56) References Cited

U.S. PATENT DOCUMENTS 4,523,777 A 6/1985 Holbein et al.
4,764,659 A 8/1988 Minami et al.
(Continued)

FOREIGN PATENT DOCUMENTS

WO 2015148619 A1 10/2015
WO 2017020574 A1 2/2017

OTHER PUBLICATIONS

International Search Report for corresponding application PCT/US2017/038541 dated Sep. 15, 2017.
(Continued)

*Primary Examiner* — Anh T Vo
(74) *Attorney, Agent, or Firm* — Norris McLaughlin, P.A.

(57) ABSTRACT

Systems and method provide a reveal substrate having a) an opaque polymer sensitive to at least one first application of at least one selected from heat, pressure and light, said opaque polymer becoming transparent upon being subjected to the at least one first application, and b) a bottom substrate layer having one or more colored areas on a top surface thereof, said bottom substrate layer being disposed such that the one or more colored areas are obscured by the opaque polymer prior to being subjected to the at least one first application and are revealed after at least one portion of the
(Continued)

opaque polymer is subjected to the at least one first application.

20 Claims, 7 Drawing Sheets

(51) Int. Cl.

| | |
|---|---|
| ***B41M 5/34*** | (2006.01) |
| ***B41M 5/36*** | (2006.01) |
| ***B41M 5/124*** | (2006.01) |
| ***B41M 5/42*** | (2006.01) |
| ***G09F 3/10*** | (2006.01) |

(52) U.S. Cl.
CPC ..... *B41M 5/34* (2013.01); *B41M 5/42* (2013.01); *G09F 3/10* (2013.01)

(56) References Cited

U.S. PATENT DOCUMENTS

| | | | | |
|---|---|---|---|---|
| 5,292,713 | A | 3/1994 | Stenzel et al. | |
| 6,124,944 | A * | 9/2000 | Ohta | H04N 1/6058 358/1.9 |
| 6,411,324 | B1 | 6/2002 | Christiansen et al. | |
| 7,182,532 | B2 * | 2/2007 | Johnson | B41J 2/32 400/237 |
| 8,054,323 | B2 | 11/2011 | Peters et al. | |
| 8,536,087 | B2 * | 9/2013 | Harrison | B41M 5/30 503/201 |
| 9,757,968 | B1 | 9/2017 | Guzzo et al. | |
| 2008/0218539 | A1 | 9/2008 | Hill et al. | |
| 2010/0245524 | A1 | 9/2010 | Peters et al. | |
| 2010/0247223 | A1 | 9/2010 | Ribi | |
| 2011/0090298 | A1 | 4/2011 | Bombay et al. | |
| 2011/0205326 | A1 | 8/2011 | Roth et al. | |
| 2013/0302550 | A1 | 11/2013 | Tang et al. | |

OTHER PUBLICATIONS

Written Opinion of the International Searching Authority for corresponding application PCT/US2017/038541 dated Sep. 15, 2017.

* cited by examiner

SYSTEMS AND METHODS FOR IMPROVING COLOR IMAGING AND PRINT HEAD ALIGNMENT, COORDINATION, REGISTRATION AND/OR RE-REGISTRATION

This application is a § 371 U.S. National stage of PCT International Patent Application No. PCT/US2017/038541, filed Jun. 21, 2017, which claims benefit of U.S. Provisional Application No. 63/352,853, filed Jun. 21, 2016, the disclosures of each of which patent applications are incorporated herein by reference.

CROSS REFERENCE TO RELATED APPLICATION

This application claims the benefit under 35 U.S.C. 119(e) of U.S. Provisional Patent Application No. 62/352,853, filed on Jun. 21, 2016 which is incorporated herein by reference, in its entireties.

FIELD OF THE DISCLOSURE

The present systems and methods improve color imaging of a substrate by aligning and/or coordinating at least one portion of at least one print head and at least one portion of color matrix reveal substrate. One or more portions of the color matrix reveal substrate is revealed, exposed and/or developed by the print head to provide color imaging on the substrate. The at least one revealed portion of the color matrix reveal substrate may be aligned with one or more locations on or associated with the at least print head to register the color imaging and/or the at least one revealed portion with the print head. The present systems and methods may maintain said alignment and/or coordination between the at least one print head and the color matrix reveal substrate while the at least print head performs and/or executes at least one pre-programmed, pre-defined and/or pre-determined print head firing sequence during at least one color imaging or printing process. In embodiments, the present systems and methods may bringing into register the color matrix reveal substrate to align with the specific locations, such as, for example, pins, posts and/or markers in or associated with the print head. If misalignment of the color matrix reveal and the at least one print head is identified and/or determined via one or more optical sensors, a first firing configuration of the at least one print head may be changed, modified, revised and/or adjusted to provide a second firing configuration which may correctly align the color matrix reveal with the at least one print head. The present systems and method may program the at least one print head and/or at least one additional print head to execute and/or perform the second firing configuration and the at least one additional print head may be positioned and/or located downstream with respect to the one or more optical sensor and/or the at least one print head.

Additionally, the present systems and methods may maintain such registration, alignment and/or coordination with the print head firing sequence to stay matched or registered during the at least one color imaging and/or printing process. In some embodiments, the color matrix reveal substrate may comprise at least a pre-formed or pre-printed color grid pattern of revealable coated material.

SUMMARY OF THE DISCLOSURE

In embodiments, a system configured to improve imaging of a substrate is provided. The system may have a reveal substrate comprising a) an opaque polymer sensitive to at least one first application of at least one selected from heat, pressure and light, said opaque polymer becoming transparent upon being subjected to the at least one first application, and b) a bottom substrate layer having one or more colored areas on a top surface thereof, said bottom substrate layer being disposed such that the one or more colored areas are obscured by the opaque polymer prior to being subjected to the at least one first application and are revealed after at least one portion of the opaque polymer is subjected to the at least one first application. Further, the system may have a print head configured to apply the at least one first application to the at least one portion of the opaque polymer when the reveal substrate moves in a moving direction pass the print head such that the one or more colored areas beneath the at least one portion of the opaque polymer are revealed to provide one or more image dots of the reveal substrate. Still further, the system may have an optical sensor positioned downstream with respect to print head in view of the moving direction of the reveal substrate, wherein the optical sensor is configured to sense the one or more image dots provided by the revealed one or more colored areas when the reveal substrate moves in the moving direction pass the optical sensor. Moreover, the system may have a computing and/or printing terminal in digital communication with the print head and the optical sensor and configured to determine alignment or misalignment of the reveal substrate and the print head based on the sensed one or more image dots provided by the revealed one or more colored areas of the reveal substrate.

In an embodiment, each of the one or more colored areas comprises at least two different colors, each of the one or more colored areas comprises a two-dimensional matrix formed by a plurality of color blocks, each one of the plurality of color blocks having only one of the at least two different colors, and the plurality of color blocks are arranged to have a repeating color pattern.

In an embodiment, the plurality of color blocks may overlap, forming overlapped areas which comprise a color formed from merging adjacent colors.

In an embodiment, the print head has a face side, adjacent to the reveal substrate, comprising a plurality of firing dots for providing the one or more image dots, wherein each firing dot is configured or adapted to: heat the at least one portion of the opaque polymer; apply pressure onto the at least one portion of the opaque polymer; and/or emit light onto the at least one portion of the opaque polymer.

In an embodiment, the print head is a thermal printing head having a plurality of firing dots on a face side adjacent to the reveal substrate, wherein each of the firing dots are configured or adapted to heat the at least one portion of the opaque polymer and/or apply pressure onto the at least one portion of the opaque polymer.

In an embodiment, the one or more image dots provided by the revealed one or more colored areas form a registration image line extending along a portion of the reveal substrate that is indicative of the alignment or misalignment of the reveal substrate with respect to the print head.

In an embodiment, the system may comprise computer-instructions and/or software, when executed by the computing and/or printing terminal, determine alignment or misalignment of the reveal substrate and the print head based, at least in part, on the sensed one or more image dots provided by the revealed one or more colored areas of the reveal substrate.

In an embodiment, the system may comprise an adhesive material applied to the reveal substrate.

In embodiments, a method for improving imaging of a printing process is provided. The method may comprise identifying a beginning of a color grid, provided on a top surface of a substrate and obscured by an opaque layer provided on the top surface of the substrate, by sensing one or more revealed image dots of the color grid, wherein the one or more revealed image dots are provided by at least one first application of at least one application selected from heat, pressure and light onto at least one first portion of the opaque layer covering the one or more revealed image dots such that said at least one first portion of the opaque layer becomes transparent to provide the one or more revealed image dots. Further, the method may comprise revealing at least one overall image on the substrate positioned thereon by a firing configuration that is based, at least in part, on the identified beginning of the color grid obscured by the opaque layer. Still further, the firing configuration may subject at least one second portion of the opaque layer to at least one second application of at least one application selected from the heat, pressure and light such that said at least one second portion of the opaque layer becomes transparent to provide the revealed at least one overall image.

In an embodiment, a print head subjects said first portion of the opaque layer to the at least one first application such that said first portion of the opaque layer becomes transparent.

In an embodiment, the print head is a thermal printing heat and the at least one first application consists of at least one application selected from heat and pressure.

In an embodiment, the method may further comprise sensing a registration image line provided by the one or more revealed image dots, and determining alignment or misalignment of the substrate and the print head based on the sensed registration image line.

In an embodiment, one or more revealed image dots of the color grid are sensed by an optical sensor or reader located downstream with respect to the print head in view of a printing direction of the substrate.

In an embodiment, the method may further comprise programming the print head with the firing configuration that is indicative of the at least one overall image and based on the identified beginning of the color grid.

In an embodiment, the identified beginning of the color grid is sensed by an optical sensor or reader located downstream with respect to the print head in view of a printing direction of the substrate.

In embodiments a method for improving imaging of a printing process is provided. The method may comprise determining a beginning of a color grid, provided on a top surface of a substrate and obscured by an opaque layer provided on the top surface of the substrate, is aligned with at least one print head, positioned downstream in a printing direction of the printing process, wherein the determined alignment is based, at least in part, on one or more revealed image dots sensed by at least one optical sensor located downstream with respect to the at least one print head in view of the printing direction of the print process, wherein the one or more revealed image dots are provided by at least one first application of at least one application selected from heat, pressure and light by the at least one print head onto at least one first portion of the opaque layer covering the one or more revealed image dots such that said at least one first portion of opaque layer becomes transparent to provide the one or more revealed image dots. Further, the method may comprise revealing at least one overall image on the substrate positioned thereon by a first firing configuration that is, at least in part, based on the determined alignment of the beginning of the color grid obscured by the opaque layer and the at least one print head. Still further, the first firing configuration may subject at least one second portion of the opaque layer to at least one second application of at least one application selected from the heat, pressure and light by the at least one print head onto the at least one second portion of the opaque layer such that said at least one second portion of the opaque layer becomes transparent to provide the revealed at least one overall image.

In an embodiment, the determined alignment is based on a registration image line, provided by the one or more revealed image dots, that is sensed by the optical sensor.

In an embodiment, the method may further comprise subsequently determining alignment or misalignment of the substrate and the at least one print head based, at least in part, on at least one other revealed image dot of the substrate sensed by the optical sensor.

In an embodiment, the method may further comprise re-aligning, when misalignment is subsequently determined, the at least one print head and the substrate based, at least in part, on the subsequently determined misalignment, wherein the re-aligning comprises determining, identifying or modifying the first firing configuration to provide a second firing configuration for the at least one print head.

In an embodiment, the method may further comprise programming the at least one print head and/or at least one second print head to execute the second firing configuration that is based, at least in part, on said re-alignment and/or said subsequently determined misalignment, wherein the at least one second print head is positioned downstream with respect to the at least one print head and/or at least one optical sensor.

In embodiments, a method for improving imaging of a printing or imaging process is provided. The method may comprise providing a bottom substrate layer having one or more colored areas on a top surface thereof, wherein the one or more colored areas on the top surface provide a color grid or matrix thereon. Further, the method may comprise applying, via a print head, an opaque print medium onto at least one first section of the top surface of the bottom substrate layer, as the bottom substrate layer moves in a printing direction of the printing or imaging process, such that the color grid or matrix provided at the at least one first section of the top surface is concealed by the applied opaque print medium and one or more second sections of the top surface remain visible so as to provide one or more visible image dots on the top surface of the bottom substrate layer. Still further, the method may comprise sensing the one or more visible image dots via an optical sensor positioned downstream with respect to print head in view of the moving direction of the printing or imaging process. Moreover, the method may comprise determining alignment or misalignment of the bottom substrate layer and the print head based, at least in part, on the sensed one or more visible image dots provided by the one or more second sections of the top surface that remain visible after application of the opaque print medium.

In an embodiment, the method may further comprise sensing, via the optical sensor, a registration image line formed or provided by the one or more visible image dots, and determining alignment or misalignment of the bottom substrate layer and the print head based, at least in part, on the sensed registration image line.

In an embodiment, the opaque print medium consists of a sole or single ink color.

In an embodiment, the opaque print medium consists of white ink.

BRIEF DESCRIPTION OF THE DRAWINGS

So that the features and advantages of the present disclosure can be understood in detail, a more particular description of the present systems and methods may be had by reference to the embodiments thereof that are illustrated in the appended drawings. It is to be noted, however, that the appended drawings illustrate only some embodiments of the present systems and methods and are therefore not to be considered limiting of its scope, for the systems and methods may admit to other equally effective embodiments.

DETAILED DESCRIPTION OF THE DISCLOSURE

The present system and method described herein are usable in conjunction with a novel color dot matrix (CMYK) reveal substrate having a heat- and/or pressure-activated opaque surface or material which becomes transparent upon activation to reveal one or more colors provided below the transparent surface, as set forth in Applicant's co-pending U.S. application Ser. No. 15/165,688, filed May 26, 2016, incorporated herein by reference, in its entirety. Applicant's novel color dot matrix reveal substrate described above is itself an improvement upon the printing substrates and methods described in Applicant's issued U.S. Pat. No. 8,054,323 (hereinafter "the '323 patent"), incorporated herein by reference, in its entirety.

As used herein, and unless stated otherwise, each of the following terms may have at least the definition set forth below.

As used herein, a "two-dimensional matrix" refers to any two-dimensional, and preferably repeating, pattern formed from a plurality of two-dimensional spaces, and can take the form of e.g., a conventional grid, a grid having a running bond pattern (where borders of the blocks forming the grid are off-set), a circular or rectangular grid. The two-dimensional spaces may be of uniform shape and/or size. The pattern may additionally include screen angles for, in particular, creating halftone images. Further, a "color block" as used herein is not limited to any specific shape, but may be any two dimensional shape, e.g., a square, rectangle circle, amorphous and/or the like.

As used herein, "about" in the context of a numerical value or range may mean at least about ±1%, about ±5%, about ±10% or less than about ±20% of the numerical value or range recited, disclosed or claimed. By any range disclosed herein, it is meant that all hundredth, tenth and integer unit amounts within the range are specifically disclosed as part of the invention. Accordingly, "about" a recited value specifically includes that recited value. For example, a range of about 100-150 mm refers to all measurements within the range of about 100 mm and 150 mm, including 100 mm and 150 mm.

As used herein, "substantially" in reference to an area, e.g., surface area, may means at least about 70%, about 80%, about 90% or more of said area.

Figure 3A:
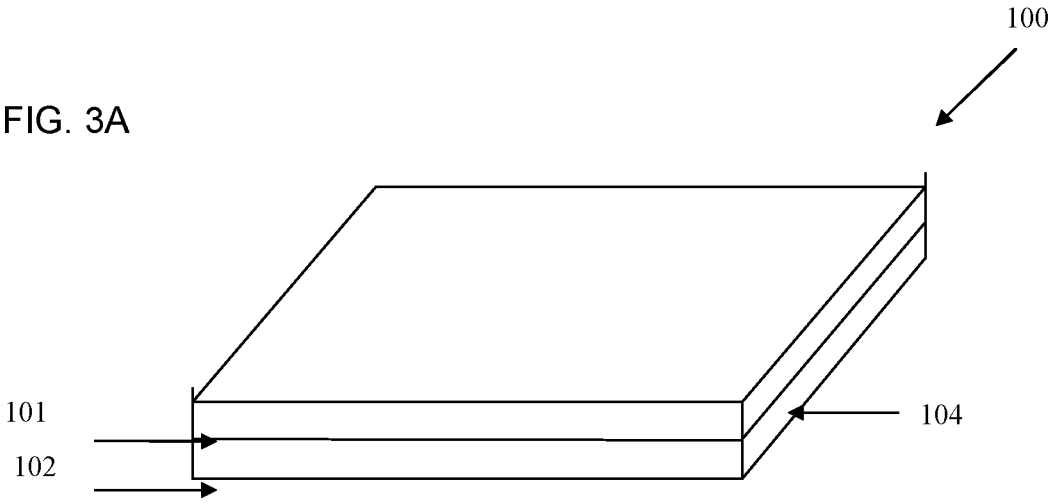
FIG. 3A shows a perspective view of a reveal substrate in an embodiment.
Figure 3B:
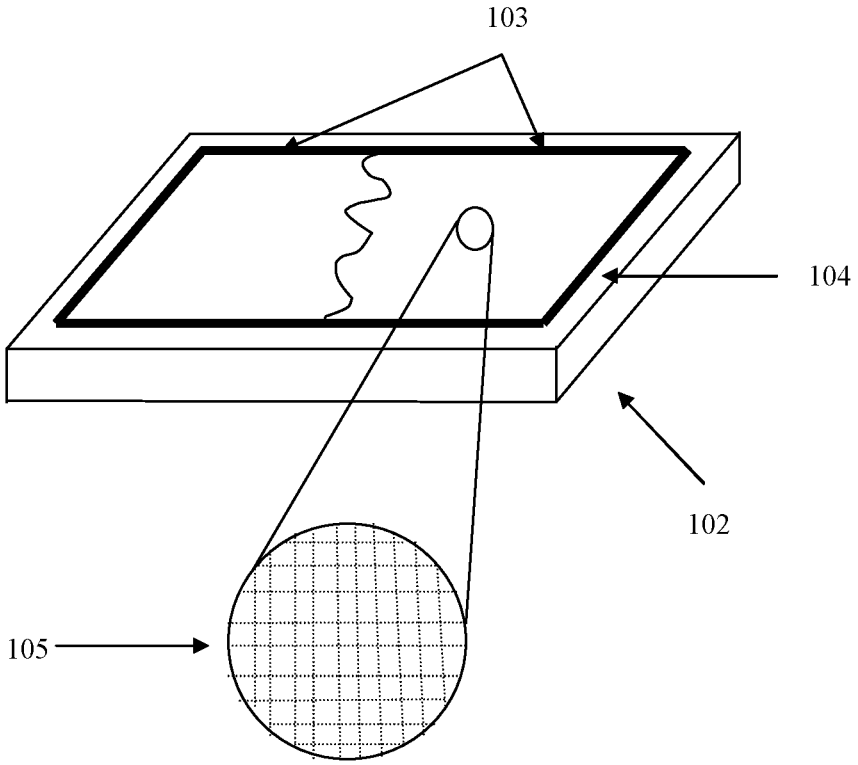
FIG. 3B shows a perspective view of the bottom substrate layer of a reveal substrate in an embodiment.

Referring now to the drawings wherein like numerals refer to like parts, FIGS. 3A and 3B illustrate a color matrix reveal substrate 100 (hereinafter "reveal substrate 100") having at least:

a) a top substrate layer 101 (hereinafter "top layer 101") comprising an opaque polymer sensitive to application of at least one selected from heat and pressure, said opaque polymer becoming transparent upon being heated to a predetermined temperature and/or subjected to a predetermined pressure; and b) a bottom substrate layer 102 (hereinafter "bottom layer 102") having one or more colored areas 103 (hereinafter "colored areas 103") on a top surface 104 of the bottom layer 102, said bottom layer 102 being disposed in a manner such that said colored areas 103 are obscured by the opaque polymer in the top layer 101 prior to at least one selected from being heated to the predetermined temperature and subjected to the predetermined pressure, and are revealed subsequent thereto.

Figure 4A:
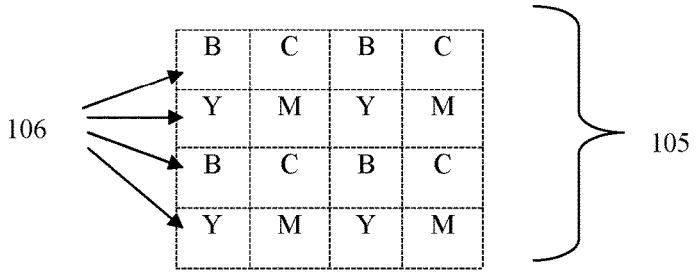
FIGS. 4A and 4B show examples of two-dimensional matrix formed by the plurality of color blocks in an embodiment.
Figure 4B:
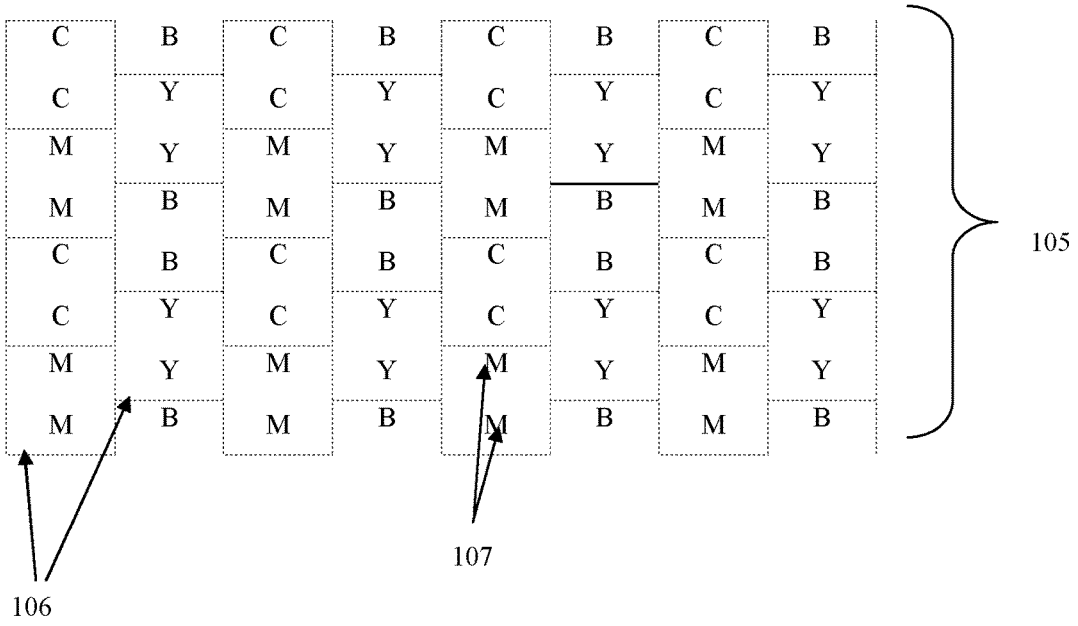

Each of the colored areas 103 may comprise at least two different colors, and each of the colored areas 103 may comprise a two-dimensional matrix 105 (hereinafter "matrix 105"). As shown in FIGS. 4A and 4B, the matrix 105 may be formed by and/or may comprise a plurality of color blocks 106 (hereinafter "color blocks 106"), each color block 106 may have only one of the at least two different colors, and the color blocks 106 may be arranged to have a repeating color pattern, design and/or indicia.

Figure 2:
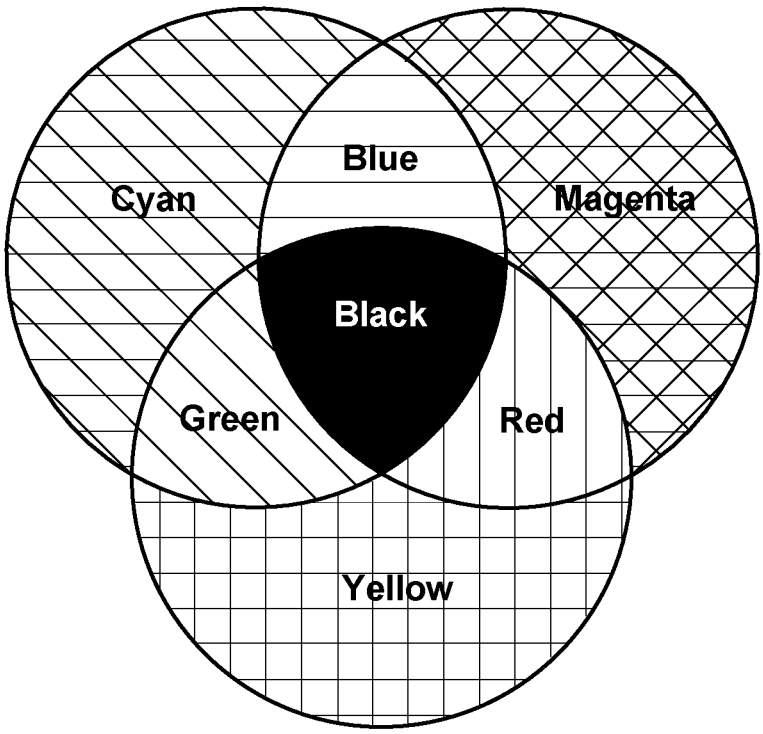
FIG. 2 illustrates colors of the subtractive CMYK color model in an embodiment.

In embodiments, each of the colored areas 103 may comprise color blocks 106 having colors of the CMYK color model, which is often used for printed color illustrations (see FIG. 2). The CMYK color model is a subtractive color model which uses the colors cyan, magenta, yellow, and key (black) and may comprise one or more overlapping areas of at least two of the colors cyan, magenta, yellow and key (black). The CMYK color model is known to those having ordinary skill in the art, and discussed in detail in, e.g., Tkalcic et al. "Colour spaces, perceptual, historical and applicational background", University of Ljubljana, EUROCON 2003, pps 304-308; and *Jennings, S. Artist's Color Manual: The Complete Guide to Working with Color. Chronicle Books LLC.* (2003).

In an alternative embodiment, each of the colored areas 103 may comprise color blocks 106 having colors of the RGB color model (not shown in the drawings), which is also usable for printing color illustrations. The RGB color model utilizes additive color mixing with primary colors of red, green, and blue. In yet another alternative embodiment, each of the color areas 103 may comprise color blocks 106 having one or more colors of at least one known color system, such as, for example, the American Munsell color system, the Swedish Natural Color System, the Optical Society of America's Uniform Color Space, the Hungarian Coloroid system and the American Pantone and the German RAL commercial color-matching system. In the alternative embodiments, it should be understood that the present disclosure is not deemed limited to a specific embodiment of the color model and/or color system provided at or by the color blocks 106 and/or the color areas 103.

In embodiments, one or more of the arrangements of colors provided on the bottom layer 102 may be in the form of a grid. The portions and/or squares of the grid, which form the matrix 105, may be lined up with respect to each other, as shown in FIG. 4A, or the portions and/or squares may be off-set with respect to each other, as shown in FIG. 4B. It should be clear to a person skilled the art that the dotted-lines of FIGS. 4A and 4B representing borders of the color blocks 106 may not be physically and visibly present on the top surface 104 of the bottom layer 102. Moreover, the color blocks 106 may be present such that one or more overlapping areas on the grid or the matrix 105 are formed or provided wherein at least two different colors may overlap each other forming an additional or different color thereon.

In further embodiments, each of the color blocks 106 may comprise a plurality of print units 107 (hereinafter "print units 107"), and all print units 107 within one color block 106 may be of the same color or of different colors. Each print unit 107 may represents the smallest distinct area which the print head may be programed to apply at least one selected from heat and pressure. For example, FIG. 4B shows a two-dimensional matrix 105 having two print units 107, e.g., in the form of a color mark/dot, per color block 106. If the two-dimensional matrix 105 is a grid having a running bond pattern, there may be ideally two or more mark/dots per square, as shown in FIG. 4B. It should be readily apparent, to one of ordinary skill in the art, that each capitalized letter (i.e., "C", "M", "Y", and "K") shown in FIGS. 4A and 4B represents a single print unit 107 of the colors cyan, magenta, yellow, and key (black), respectively. Although in other accompanying drawings, the print units 107 may be shown as squares or octagons, other geometric shapes are also possible and/or usable. In addition, the print units 107 may be amorphous and/or have a shape resembling that of a splatter, dot, droplet and/or the like.

Providing the blocks of the grid in a running bond pattern (where borders of the blocks forming the grid are off-set) may be beneficial by providing increased combinations of neighboring colors of neighboring color blocks 106, thereby providing increased overall color and shading combinations available and/or provided by the matrix 105. Similarly, by including more than one print unit 107 per color block 106, it may be possible to adjust at least one selected from intensity and saturation of colors in the overall design of the matrix 105 by, for example, revealing only one, two, or three or more of the print units 107 in a single color block 106. In this manner, the design of the matrix 105 may provide increased combinations of neighboring colors, thereby providing further increased overall color and shading combinations available and/or provided by the matrix 105.

In other embodiments, the color blocks 106 may overlap, forming overlapped areas (not shown in the drawings) which may comprise a color formed from merging colors of the adjacent color blocks 106 based on the appropriate color model used. In yet other embodiments, each of the color blocks 106 may comprise a plurality of print units 107, and all print units 107 within one color block may be of the same color or of different colors. For example, the matrix 105 may be a grid having a running bond pattern, wherein the color blocks 106 may overlap, and each color block 106 may comprise more than one print unit 107, such as, for example, four print units 107 having the same color or different colors. Although the more than one print unit 107 may not overlap with the overlapped areas or neighboring print units 107, it should be understood that that area encompassed by the print units 107 and the overlapped areas are not intended to be mutually exclusive.

Figure 1:
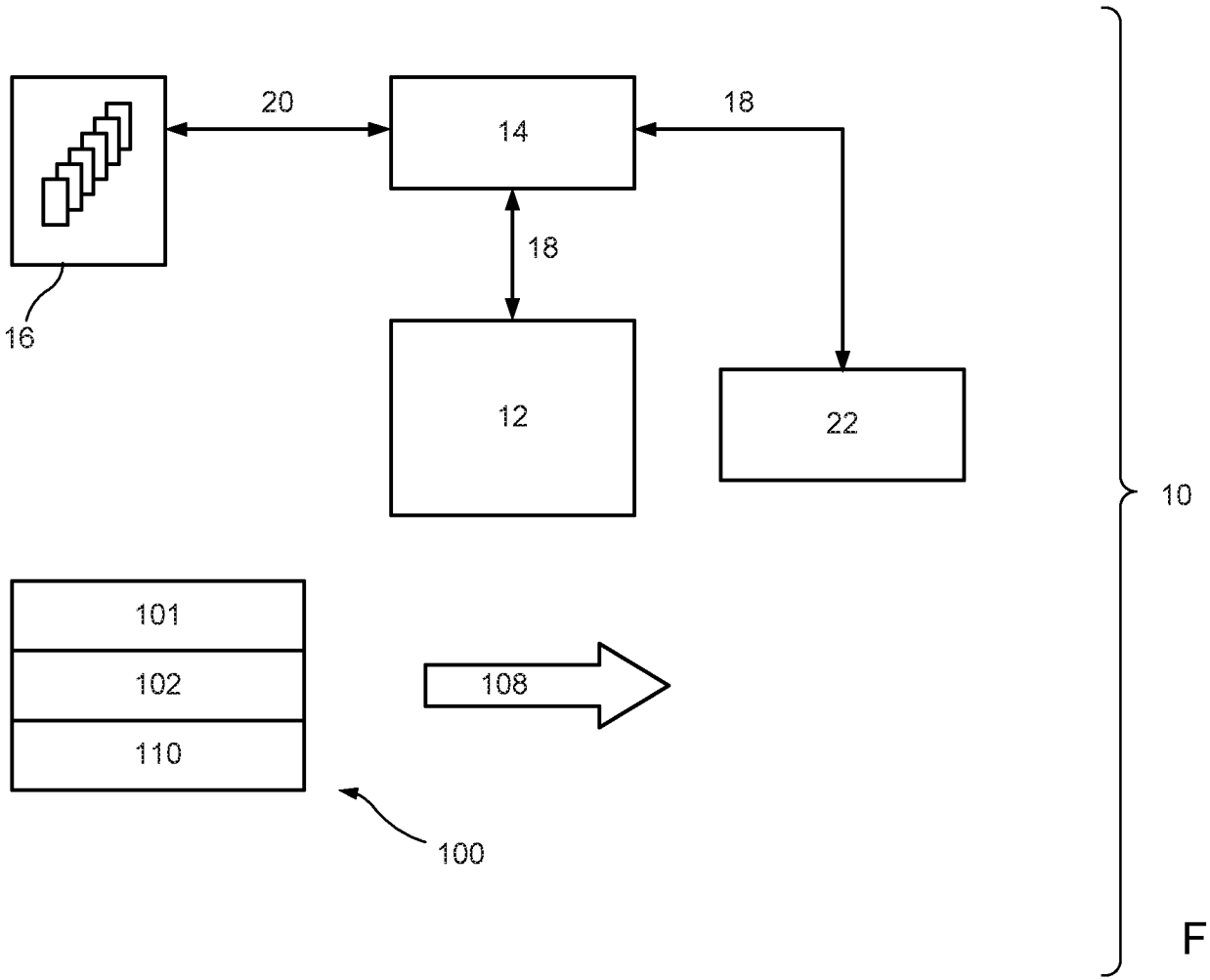
FIG. 1 illustrates a block diagram of a system configured to improve color imaging and print head alignment, coordination, registration and/or re-registration in an embodiment.
Figure 5:
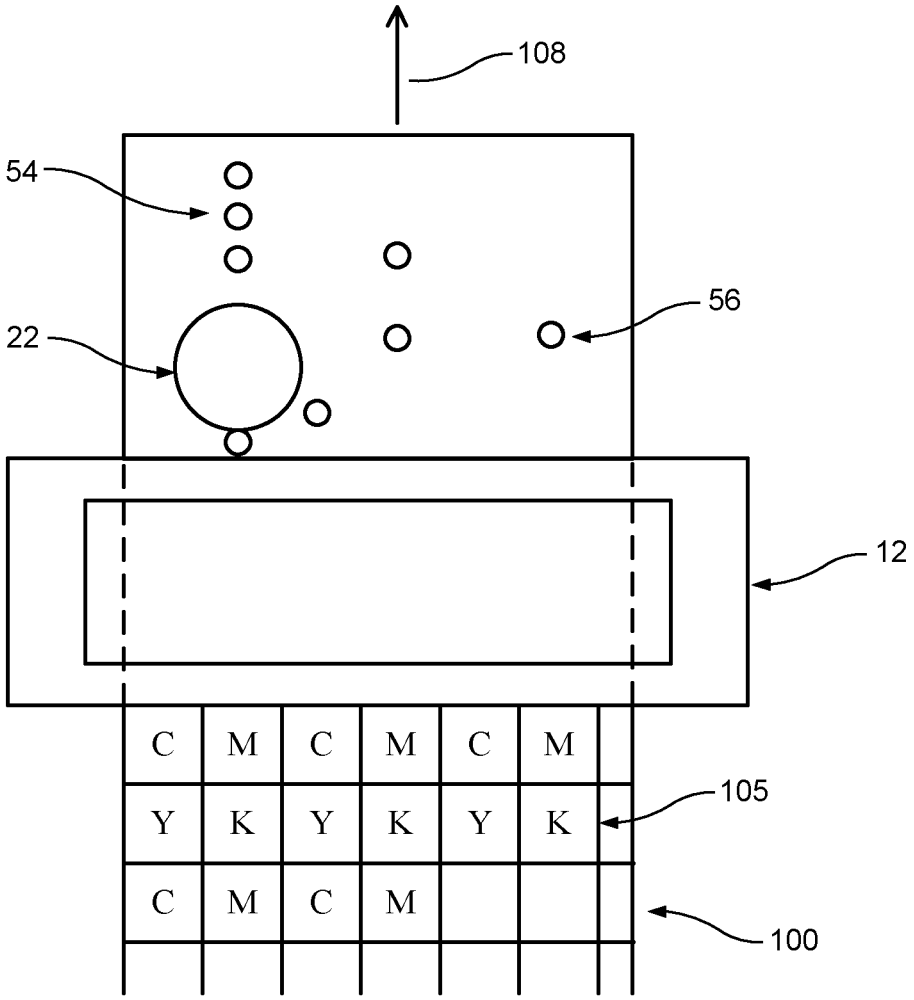
FIG. 5 illustrates a top view of a system configured to improve color imaging and print head alignment, coordination, registration and/or re-registration in an embodiment.
Figure 6:
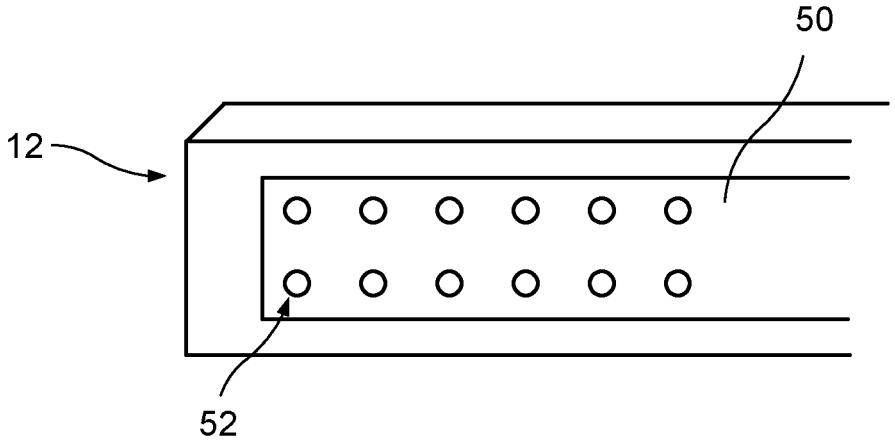
FIG. 6 illustrates a bottom view or face-side view of a print head in an embodiment.

Additionally, it may not be necessary to have print units 107 present as distinct areas of the matrix 105. Benefits may be achievable by providing, within a color block 106, a colored area that may be two-, three-, four-times or more of the size of the smallest print unit 107, then simply programming at least one print head 12 (hereinafter "print head 12"), as shown in FIGS. 1, 5 and 6, to activate only one or more portions thereof. In other words, multiple print units 107 may be provided within a color block 106 wherein the print units 107 may lack distinct and/or defined boundaries. The opaque polymer of the top layer 101 may haves a melting point of at least about 37° C., about 37-150° C., about 80-150° C. or about greater than 150° C. In an embodiment, the opaque polymer may comprise more than one polymer or a copolymer, such as, for example, styrene acrylic-copolymer. In another embodiment, the opaque polymer may comprise a hollow sphere pigment (hereinafter "HSP") which may appear opaque as a result of its light scattering properties. In other embodiments, the opaque polymer may have a physical and/or chemical structure that may be altered and/or changed by application of pressure such that the opaque polymer becomes transparent or at least substantially transparent. In one or more other embodiments or alternative embodiments, the opaque polymer of top layer 101 may be in accordance, or substantially in accordance, with one or more opaque polymers set forth in Applicant's co-pending U.S. application Ser. No. 15/598,006, filed May 17, 2017, incorporated herein by reference, in its entirety.

In embodiments, the colored areas 103 may be substantially coated onto and/or provided one the bottom layer 102. In other embodiments, the colored areas 103 may extend substantially across the top surface 104 of the bottom layer 103. In another embodiment, the opaque polymer of the top layer 101 may substantially cover or block at least one or more colored areas 103. In another embodiment, the reveal substrate 100 may comprise no adhesive, or comprise an adhesive material applied thereto.

The adhesive material may be present as at least one additional layer 110 (hereinafter "additional layer 110") as shown in FIG. 1 which may be provided on the bottom layer 102 or on the top layer 101 (not shown in the drawings). If the additional layer 110 is provided thereon, it may comprise or include one or more pigments, dyes, colorings and/or the like. In an embodiment, the adhesive material is provided as the additional layer 110 and may comprise or be, for example, an activatable adhesive, a pressure-sensitive adhesive, a rubber-based adhesive, a curable adhesive and/or the like. In another embodiment, the additional layer 110 may be a release layer, liner and/or substrate which may have, for example, a mating surface applied over the bottom layer 102 and the pressure sensitive adhesive if provided on the reveal substrate 100. In an embodiment, the release layer, liner and/or substrate may be a paper- and/or polymer-based substrate. In yet another embodiment, the additional layer 110 may be a cover layer, backing layer and/or another opaque polymer layer provided on either, or both, the top layer 101 and/or the bottom layer 102.

Turning to FIG. 1, a system 10 for improving alignment, coordination, registration and/or re-registration of the reveal substrate 100 and the print head 12 is provided in this embodiment. The system 10 may be an imaging and/or printing system comprising at least one or more of the following: at least one print head 12, at least computing and/or printing device 14 (hereinafter "device 14"), at least one digital storage device, memory and/or database 16 (hereinafter "database 16"), at least one first digital communication network 18 (hereinafter "first network 18"), at least one second digital communication network 20 (hereinafter "second network 20"), at least one sensor and/or reader 22 and/or any combination thereof. The present disclosure should not be deemed as limited to a specific number of print heads, computing/printing devices, databases, sensors, readers and/or digital communication networks which may access and/or may utilize the system 10. The present systems and methods may include and/or incorporate any number of print heads, computing/printing devices, databases, sensors, readers and/or digital communication networks as known to one of ordinary skill in the art.

In embodiments, the device 14 may be one or more portable digital devices, one or more handheld digital devices, one or more computer terminals, one or more computer servers, one or more printer drivers, one or more print processors or any combination thereof. In embodiments, the device 14 may be a wired terminal, a wireless terminal or any combination thereof. For example, the device 14 may be wireless electronic media device, such as, for example, a tablet personal computer (hereinafter "PC"), an ultra-mobile PC, a mobile-based pocket PC, an electronic book computer, a desktop computer, a laptop computer, a video game console, a digital projector, a digital television, a digital radio, a media player, a portable media device, a PDA, an enterprise digital assistant and/or the like. In other embodiments, the device 14 may be, for example, a hyper local digital device, a location-based digital device, a GPS-based digital device, a mobile device (i.e., a 4G mobile device, a 3G mobile device or the like), an ALL-IP electronic device, an information appliance or a personal communicator. The present disclosure should not be deemed as limited to a specific embodiment of the device 14.

In embodiments, the device 14 may have at least one display for displaying or rendering information and/or multimedia data stored in a memory or at least one digital storage device accessible by a microprocessor (not shown in the drawings) of the device 14, stream to the device 14 or a combination thereof. In an embodiment, the display of the device 14 may be a touch-screen graphic user interface (hereinafter "GUI") or a digitized screen connected to the microprocessor of the device 14. The device 14 may display or render information and/or data associated with the color imaging, the print head 12, the database 16, the first network 18, the second network 20, the reader 22, the reveal substrate 100 (including information and/or data with respect to the top layer 101, the bottom layer 102, the colored areas 103, the top surface 104, the matrix 105, the color blocks 106 and/or the print units 107) and/or any combination thereof. The selected information and/or data may facilitate improved alignment, coordination, registration and/or re-registration of the reveal substrate 100 with the print head 12 by the system 10 and/or the method 200 shown in FIG. 8.

In embodiments, the device 14 may have one or more communication components for connecting to and/or communicating with the print head 12, the reader 22, the first network 18, the second network 20 and/or any combinations thereof. In an embodiment, the one or more communication components of the device 14 may be a wireless transducer, such as, for example, a wireless sensor network device, such as, for example, a Wi-Fi network device, a wireless ZigBee device, an EnOcean device, an ultra-wideband device, a wireless Bluetooth device, a wireless Local Area Network (hereinafter LAN) accessing device, a wireless IrDA device and/or the like. As a result, the device 14 may be, via the one or more communication components, in digital communication with the print head 12, the reader 22, the first network 18, the second network 20 and/or any combinations thereof.

The device 14 may connect to and/or may access the first network 18 and/or the second network 20 via the one or more communication components of the device 14. In an embodiment, the device 14 may be electronically connected to and/or in digital communication with the print head 12 and/or the reader 22 via the first network 18 as shown in FIG. 1. In another embodiment, terminal 12 may be directly and electronically connected to and/or in direct digital communication with the database 16 via the second network as shown in FIG. 1. In yet another embodiment, the database 16 may be integrated into, or part of, the device (not shown in the drawings). In embodiments, the database 16 may be assigned to the device 14 and/or may provide the device 14 with digital, electronic files, such as, for example, printable files, software files, instructional files, graphical/imaging files, format/font files, informational files and/or other known digital files that are usable by the system 10 for color imaging the reveal substrate 10 and/or print head re-registration of print head 12.

In embodiments, the database 16 may be a memory or storage medium that is local with respect to the device 14 or may located remotely with respect to the device 14, whereby "remotely" means positioned at a different location than the device 14. Similar to the database 16 and/or the device 14 may be located locally or remotely with respect to the print head 12 and/or the reader 22. In an embodiment, the system 10 and/or the database 16 may comprise one or more additional computing and/or printing systems and/or may be distributed across multiple servers or datacenters (not shown in the drawings).

Figure 8:
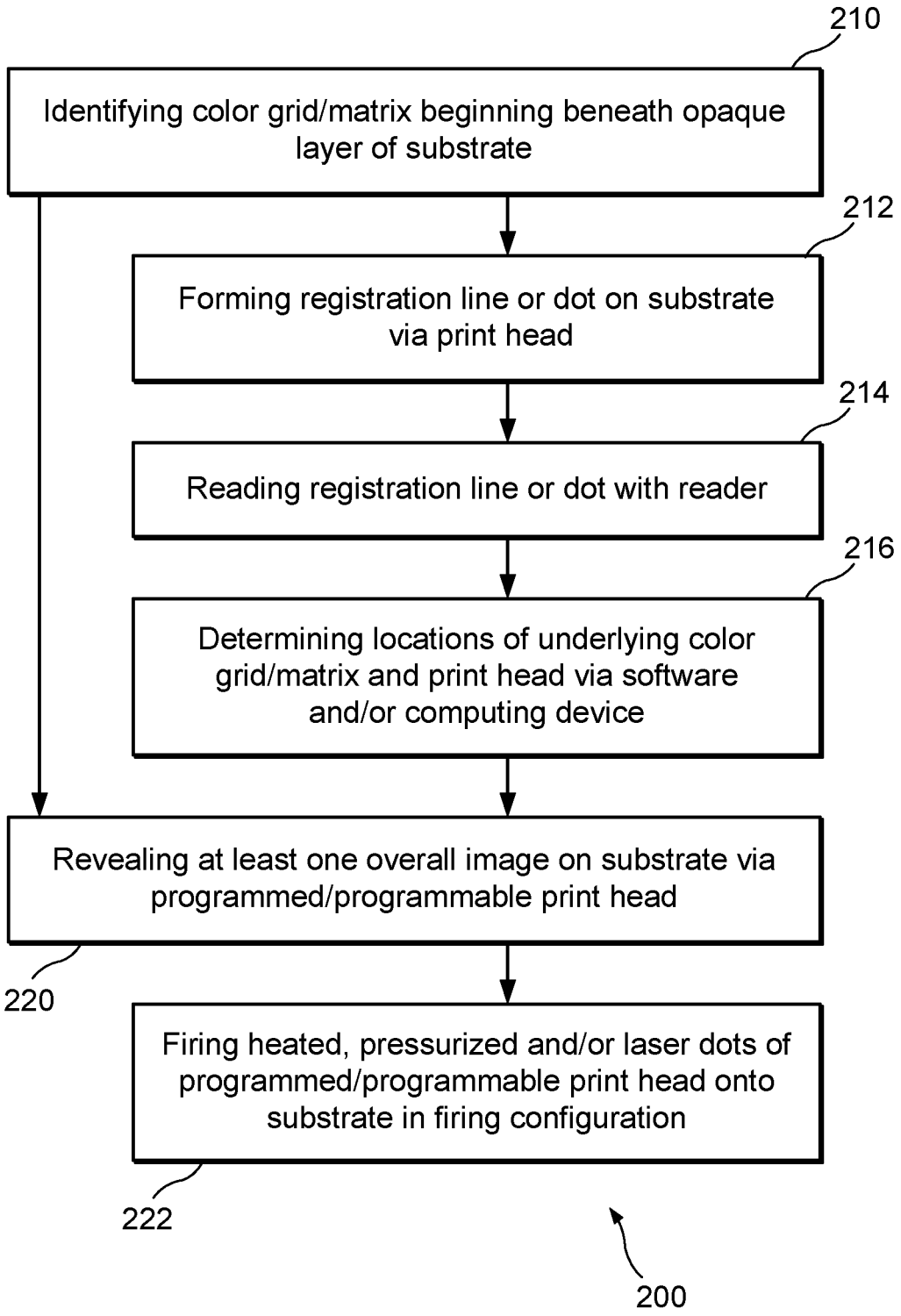
FIG. 8 illustrates a flowchart of a method for improving color imaging and print head alignment, coordination, registration and/or re-registration in an embodiment.

A memory, digital storage device and/or non-transitory computer-readable medium of the database 16 and/or the device 14 may have stored thereon the executable computer printing instructions, the one or more computer printing programs, the one or more printing algorithms and/or software (hereinafter "software") that, when executed by the microprocessor of the device 14, perform the one or more color imaging steps of the present method 200 via the system 10 as shown in FIG. 8. In embodiments, the executable computer-instructions and/or software accessible by device 14 from database 16 comprise novel and inventive color imaging computer instructions and/or software (hereinafter "color imaging software") which may be selected from at least color image separation software, image pattern recognition software and/or dot reveal pattern software discussed hereinafter. In one or more embodiments or alternative embodiments, the computer-instructions and/or software executable by the device 14 may be provided by and/or accessible from at least one selected from KNUEDGE, Inc., SCIENCESOFT, Inc., DYNAMIC VENTURES, Inc. (d/b/a ComputerVisionSoftware.com) and the like.

In embodiments, the first network 18 and/or the second network 20 (hereinafter collectively known as "networks 18, 20") may be, for example, a personal area network (PAN), a local area network (LAN), a campus area network (CAN), a Metropolitan area network (MAN), a wide area network (WAN) and/or the like. In an embodiment, the networks 18, 20 may be a wireless network, such as, for example, a wireless MAN, a wireless LAN, a wireless PAN, a Wi-Fi network, a WiMAX network, a global standard network, a personal communication system network, a pager-based service network, a general packet radio service, a universal mobile telephone service network, a radio access network and/or the like. In an embodiment, the networks 18, 20 may be a fixed network, such as, for example, an optical fiber network, an Ethernet, a cabled network, a permanent network, a power line communication network and/or the like. In another embodiment, the networks 18, 20 may be a temporary network, such as, for example, a modem network, a null modem network and/or the like. In yet another embodiment, the networks 18, 20 may be an intranet, extranet or the Internet which may also include the world wide web. The present disclosure should not be limited to a specific embodiment of the networks 18, 20.

In embodiments, the print head 12 is sized, shaped, configured and/or adapted to exert and/or apply at least one selected from heat and pressure onto the reveal substrate 100. More specifically, the print head 12 applies and/or exerts heat and/or pressure onto the top layer 101 of the reveal substrate such that one or more portions of the opaque polymer selectively are changed and/or transformed into transparent, or at least substantially transparent, material exposing, uncovering and/or revealing selected color areas 103 of the reveal substrate.

In embodiments, the print head 12 is a thermal print head and/or may be part of thermal imaging printer such that the print head 12 may produces a printed and/or color image by selectively heating one or more selected or pre-determined/pre-defined portions of the coated reveal substrate 100. In an embodiment, the print head 12 is a thermal print head having a width of less than about four (4) inches, about four (4) inches, greater than about four (4) inches, about six (6) inches or greater than about six (6) inches, and about eight (8) inches or greater than about eight (8) inches. In other embodiments, the print head 12 is a thermal print head having printing or imaging speed of less than two (2) inches per second, from about two (2) to about six (6) inches per second, from about two (2) to about eight (8) inches per second or greater than about eight (8) inches per second. In one or more embodiments or alternative embodiments, the print head 12 may be a thermal print head provided by at least one selected from KYOCERA, Corp., GULTON, Inc. and the like.

In embodiments, the print head 12 may comprise at least one first print head 12 and at least one second print heads 12 (not shown in the drawings). For example, the at least one print head 12 may be located upstream with respect to the reader 22 in the printing process and the at least one second print head 12 may be located downstream with respect to the reader 22 in the printing process. In an embodiment, both the at least one first print head 12 and the at least one second print head 12 may be a thermal print head as discussed herein. It should be understood that the present disclosure is not limited to a specific number of print heads 12 and/or readers 22.

In embodiments, the reader 22 may be an optical sensor or reader adapted and/or configured to identify, sensor and/or determine one or more visual characteristics of the reveal substrate 100 after passing through or by the print head 12. In embodiments, the reader 22 is a color optical sensor or reader adapted and/or configured to identify, sensor and/or determine one or more visual color characteristics of the reveal substrate 100 after one or more portions of the opaque polymer have changed or been transformed into transparent material revealing one or more color areas 103 on the top surface 104 of the bottom layer 102. In one or more embodiments or alternative embodiments, the reader 22 may be provided by at least one selected from TRI-TRONICS, KEYENCE, Corp., MOUSER ELECTRONICS, Inc. and the like.

In other embodiments, the system 10 may comprise two or more readers 22 configured and/or adapted to determine one or more specific locations and/or points on the top surface 104 of the bottom layer 102 and/or the matrix 105 on the bottom layer 102. For example, the two or more readers 22 may determine at least one location of a point, such as, for example, at least one color area 103, at least one color block 106 and/or at least one print unit 107 that may be provided on the top surface 104 and/or matrix 105 of the bottom layer 102. In an embodiment, the two or more readers 22 may form angles to the at least one location of the point to from other known points (i.e., revealed color blocks 106 and/or print units 107) on the top surface 104 or matrix 105 of the bottom layer 102. In one embodiment, the two or more readers 22 may determine and/or identify the at least one location of the point by forming triangles, or utilizing triangulation, to the at least one location of the point from the other known points on the top surface 104 and/or matrix 105 of the bottom layer 102. By determining and/or identifying the correct location of the point, from forming the angles, the two or more readers 22 may confirm that the alignment between the reveal substrate 100 and print head 12 may be correct and/or accurate with respect to each other or may be incorrect with respect to each other and further requires adjustment and/or movement with respect to each other.

In embodiments, the reveal substrate 100 may be paper or film media that is usable with the print head 12 during a printing and/or imaging process. In an embodiment, the paper or film media is usable with the print head 12 to produce thermal color imaging of the reveal substrate 100. In an embodiment, the paper or film media may be a color imaging paper label stock which may include at least black (K) color imaging along with one or more of the other three colors of the CMYK color model. In an embodiment, the label stock may have two-dimensional sizing, such as, for example, about four (4) inches by about two (2) inches, about four (4) inches by about four (4) inches or about four (4) inches by about six (6) inches. Additionally, the color areas 103 provided on the matrix 105 of the reveal substrate 100 may be customizable if so desired for a specific embodiment of the paper, label and/or film media. It should be understood that the present disclosure is not deemed limited as to a specific embodiment(s) of the paper or film media and/or the two-dimensional sizing of the label stock.

As shown in FIGS. 1, 2A, 2B, the reveal substrate 100 may comprise, in embodiments, the top layer 101 made from the opaque polymer as described in the '323 Patent, and a bottom layer 102 having colored areas 103, each of which comprises the matrix 105 formed by a plurality of the color blocks 106 and/or color blocks 106 comprising a single or sole color, which may be arranged to have one or more repeating color patterns. In an embodiment, the opaque polymer of the top layer 101 may be sensitive to application of one of heat and pressure by the print head 12, which upon one of being heated to a predetermined temperature or subjected to a predetermined pressure, respectively, applied by the print head 12 causes the opaque polymer to change, transform or become transparent or a transparent polymer material. As a result, color material and/or the color areas 103 disposed below or beneath said transparent polymer material may be revealed thereto to produce color imaging on the reveal substrate 100.

In embodiments, the reveal substrate 100 comprises the bottom layer 102 having the one or more colored areas 103 on a top surface 104 thereof, said bottom layer 102 being disposed in a manner such that said one or more colored areas 103 are obscured by the opaque polymer (prior to being heated to the predetermined temperature or subjected to the predetermined pressure) and are revealed subsequent thereto by application of the print head 12. Additionally, each of the one or more colored areas 103 may comprise at least two different colors, each of the one or more colored areas 103 may comprise the matrix 105 formed by a plurality of color blocks 106, each one of the plurality of color blocks 106 may have only one of the at least two different colors, and/or the plurality of color blocks 106 may be arranged to have at least one repeating color pattern.

In embodiments, the reveal substrate 100 has the top layer 101 (which may be made from the opaque polymer as described in the '323 Patent), and the bottom layer 102 which may have colored areas 103 comprising at least two (2) different colors of the CMYK color model, or preferably at least 3, 4 or more different colors. These different colored areas 103 may each comprises the matrix 105 formed by a plurality of color blocks 106, each one of the plurality of color blocks 106 having only one color, and the plurality of color blocks may be arranged to have at least one repeating color pattern. The colors of the color blocks 106 are preferably colors of known color models such as, for example, the CMYK color model.

In embodiments, the print head 12 may be a thermal print head programmed or programmable, via the device 14 and/or database 16, to heat only, or substantially only, a selected or desired section or one more portions of the top layer 101 which may corresponds in position or location to selected or desired color blocks 106 or portions of selected color blocks 106. As a result, only, or substantially only, the selected and/or desired colors at the selected and/or desired locations may be revealed by the application of heat from the print head 12. As a person having ordinary skill in the art would appreciate, a multitude of colors can be formed by using the basic colors of the CMYK model. Moreover, the reveal substrate 100 may move in substrate path direction or print direction 108 (hereinafter "print direction 108") such that printer head 12 may apply heat and/or pressure to the top layer 101 of the reveal substrate 100 as shown in FIGS. 1 and 5.

Thus, the print head 12 may be programmed and/or programmable, via the device 14 and/or database 16, to reveal at least one overall image that may not be limited to a single block color. Instead, the at least one overall image may be, for example, a picture, a graphic and/or indicia. In an embodiment, the at least one overall image may have a range of one or more colors, of one or more color intensities and/or of one or more designs formed by careful, predetermined, pre-defined and/or customizable selection of one or more color combinations of the colors of the CMYK color model. In an embodiment, the reveal substrate 100 may allow and/or facilitate at least one dithering technique to be applied to thermal printing of the reveal substrate 100 when, or if, the print head 12 is in the form of a thermal print head or part of a thermal printer.

In embodiments, the color blocks 106 and/or print units 107 within said color blocks 106 may be sufficiently and/or substantially small in size such that a human being viewing the substrate from a distance will more readily perceive the at least one overall image, picture and/or indicia (not shown in the drawings) formed on the reveal substrate 100, rather than the individual selected color blocks 106, print units 107 and/or portions thereof. In an embodiment, the color block 106 may be the same size, or substantially the same size, as the smallest dot or droplet (i.e., print unit 107) that may be printed or printable by a color print head of a color printer or imaging device (not shown in the drawings). In addition, the color block 106 may be about two (2) times, about three (3) times, about four (4) times or about more than four (4) times of the size of said smallest dot or droplet printable by the color print head. The size of the smallest dot or droplet that may be fired by the color print head may depend on the quality of the color printer or imaging device. For example, a conventional color printers used in the art have color print heads that can print between about 200 to 300 dots per inch on the lower quality end, and up to about 600 dots per inch on the higher quality end. In an embodiment, said smallest dot may have areas ranging from about 0.11 $mm^2$ to about 0.1 $mm^2$. Accordingly, the reveal substrates of the present systems and methods may provide for greater range of customization and graphic capabilities, as compared to substrates described in the '323 patent. For example, the present reveal substrates 100 may allow for thermal printing or imaging of halftone images, which was not possible on known prior art substrates.

Figure 7:
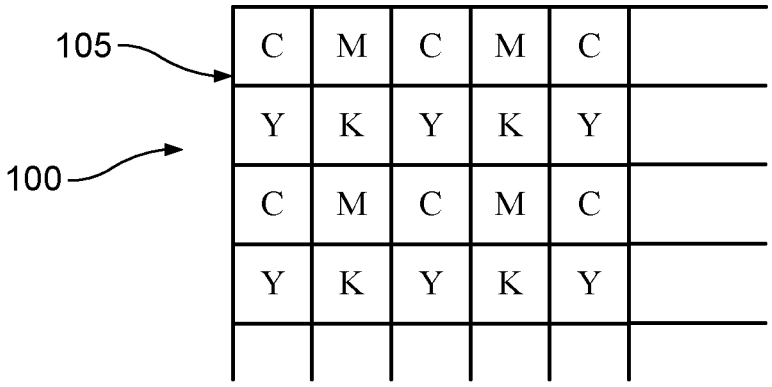
FIG. 7 illustrates a top view of color matrix reveal substrate in an embodiment.

In yet other embodiments of the reveal substrate 100, each of the one or more colored areas 103 may comprise color blocks 106 having one or more colors of the CMYK color model, which is often used for printed or imaged color illustrations. In one embodiment, the arrangement of colors on the bottom layer 102 may be in the form of the grid or matrix 105 as previously described herein. The squares of the grid or matrix 105 may be lined up with respect to each other as shown in FIGS. 3A, 5 and 7 or the squares may be off-set with respect to each other as shown in FIG. 4B.

In a further embodiment of the reveal substrate 100, each of the color blocks 106 comprises the print units 107, and all print units 107 within one color block 106 are of the same color. Each print unit 107 represents the smallest distinct area which the print head 12 can be programed or programmable, via the device 14 and/or database 16, to apply heat or pressure. Where the matrix 105 is the grid which may have a running bond pattern, there may be two or more mark/dots/droplets per square. In said embodiment as shown in FIGS. 3A, 3B, 5 and 7, it should be readily apparent that each capitalized letter "C", "M", "Y", "K" represents a single print unit of the colors cyan, magenta, yellow, and key (black), respectively. Again, the print units 107 may be in the form of squares, octagons and/or other different geometric shapes and/or have a shape resembling that of a splatter, dot and/or droplet.

Providing the color blocks 106 of the grid or matrix 5 in a running bond pattern (where borders of the blocks forming the grid are off-set) has the benefit of providing increased combinations of neighboring colors, thereby providing increased overall color and shading combinations available. Similarly, by including more than one print unit 107 per color block 106, it may be possible to adjust at least one selected from the intensity and the saturation of colors in the overall image and/or design by, for example, revealing only one, two, or three or more of the print units 107 in a single color block 106. In this manner, the image and/or design provides increased combinations of neighboring colors, thereby providing further increased overall color and/or shading combinations available for printing and/or imaging processes completed and/or executed by the system 10 and/or the method 200.

Further, it may not be necessary to have or provide print units 107 present as distinct areas of the matrix 105. The above-described benefits can be achieved by providing, within a color block 106, a colored area 103 that may be about two times, about three times, about four times or about more than four times of the size of the smallest print unit 107, then programming, via the device 14 and/or database 16, the print head 12 to activate only portions thereof. In other words, multiple print units 107 may be provided within a color block 106 which print units 107 may lack distinct boundaries thereon.

In embodiments, the present method may thermally print one or more overall or partial images, pictures and/or indicia by (a) programming the print head 12, via the device 14 and/or database 16, to apply at least one selected from heat and pressure to at least one section of the top layer 101 of the reveal substrate 100 as described herein. The at least one section of the top layer 101 may correspond in position to and/or may obscure selected color blocks 106 and/or portions of the selected color blocks 106 present on the top surface 104 of the bottom layer 102. The present method may include (b) applying heat to the section, or portion of the section, of the top layer 101 to a predetermined temperature or, or subjecting the section, or portion of the section, of the top layer 101 to a predetermined pressure, thereby causing the opaque polymer of said section, or portion of the section, of the top layer 101 to become transparent, and thereby revealing the selected color blocks 106 or portions thereof. The selected color blocks 106 or portions thereof revealed in (b) may be sufficiently and/or substantially small such that a human being perceives the overall image, picture and/or indicia formed by said selected color blocks 106 or portions thereof.

The present systems and methods may perform, execute and/or achieve at least one print head registration and/or at least one print head re-registration as described hereinafter.

When the print head 12 is in the form of a thermal print head, the printing/imaging system 10 works or operates on the concept of providing a heat pulse at a predetermined spot on the print head 12 to activate a color change in the opaque polymer changing or transforming to a transparent material such that the color blocks 106 under or beneath the transparent material may be revealed for color imaging or printing the reveal substrate 100.

In traditional black and white thermal printing, the precision of exactly where the spot is activated on the substrate is not that important since the image color is the same everywhere on the material. The only accuracy needed is the geometric space between the dots formed with respect to each other, not with respect to the material itself. Therefore and in view of these aspects of traditional black and white thermal printing, re-registration has never been necessary. However, to align the firing on the print head 12 with a predetermined, preprinted dot or color block 106 under the opaque polymer coating on the top layer 101 requires precise alignment of the exact firing spot on the print head 12 and the predetermined, dot or color block 106 on the top surface 104 of the bottom layer 102 on the reveal substrate 100. The present systems and methods accomplish improved re-registration simply and with greatly improved accuracy than previous methods known in the art.

Known computer software, when executed by a computing device, separates color images into the CMYK color model, but are traditionally used to direct other known printing methods, such as, for example, ink jet, flexo, gravure, screen print, laser and ion deposition. However, these known printing methods do not require the utilized printing head to be aligned with the substrate being printed, as these known printing methods are only required to keep the positions of the printed ink dots aligned with respect to each other.

The present system and methods utilize one or more novel color imaging software, such as, for example, novel color image separation software, novel image pattern recognition software and/or novel dot reveal pattern software. The one or more novel color imaging software, when executed and/or performed by the device 14, may energize a dot on print head (i.e., thermal print head) in the correct location to reveal the desired color of an underlying color block 106 and/or print unit 107 if the preprinted material grid pattern and/or matrix 105 is correctly and/or accurately recognized and aligned.

Known re-registration methods traditionally involve physically moving the substrate to match a desired firing pattern or location of the firing print head. First, the firing pattern or location has to be identified, and, then the material or substrate and the firing print head must be correctly and/or accurately aligned. However, correct and/or accurate alignment is difficult, if not impossible, to accomplish within the framework of a simple direct thermal printer and, if alignment or re-registration is accomplished, said alignment or re-registration methods are subsequently slow and excessively cumbersome to match in view of numerous small dots utilized during the pattern firing process.

In another known method, the print head may be physically and/or mechanically moved to align with the preprinted material, though this other known method is also difficult to control such precision increments in view of numerous small dots utilized during the pattern firing process.

The one or more novel color imaging software (i.e., novel color image separation software, novel image pattern recognition software and/or novel dot reveal pattern software), when executed by system 10 and/or utilized by method 200, may identify a beginning of the color grid or matrix 105 and may subsequently move the firing positions of one or more dots 52 (hereinafter "dots 52") along/across a length and/or width of a face side 50 of the print head (as shown in FIG. 6) to align with the preprinted dots which may be provided by the color blocks 106 and/or the print units 107. In embodiments, the dots 52 firing on the face side 50 of the print head 12 may be heated dots 52. Said movements of the firing positions of the print head 12 may be as precise as the size of one dot and/or may happen as quickly or rapidly as the current pulses that are firing at the dots 52 on the face side 50 of the print head 12.

In some embodiments, the print head 12 may remain stationary with respect to the reveal substrate 100 while the firing positions of the heated dots 52 move across/along the length and/or the width of the face side 50 of the print head 12. In other embodiments, the print head 12 may be movable with respect to the reveal substrate 100.

Identifying the beginning of the color grid or matrix 105 below the opaque coating or polymer material of the top layer 101 may be accomplished by heating a continuous line in the print direction 108 or in any continuous location via the heated dots 52 of the print head 12. In embodiments, the continuous line or location may have a width comprises at least one dot or at least two or more dots.

After the continuous line or location is heated by the heated dots 52 of the print head 12, one or more of the color blocks 106, print units 107 and/or portions thereof are revealed by the opaque coating or polymer material changing or becoming transparent, or at least substantially transparent, material. The revealed color blocks 106, print units 107 and/or portions thereof may form and/or define at least one selected from a registration image line 54 and one or more color image dots 56 (hereinafter "image dots 56") on the reveal substrate 100 as shown in FIG. 5.

Next, the system 10 and/or the method 200 may read, inspect and/or record the registration image line 54 and/or image dots 56 with the reader 22 to determine the precise location of the underlying color pattern and/or matrix 105 with respect to the location of the print head 12. The one or more novel color imaging software (i.e., novel color image separation software, novel image pattern recognition software and/or novel dot reveal pattern software), when executed and/or performed by the device 14 and/or database 16, may continuously loop the reading, inspecting and/or recording performed by the reader 22 so as to correctly determine the precise location of the underlying color pattern and/or matrix 105 as the reveal substrate 100 may move past the print head 12 in the print direction 108.

Next, the system 10 and/or the method 200 may control the print head 12 to fire one or more the heated dots 52 of the print head 12 in one or more same or different configurations (hereafter "firing configurations"). In embodiments, the firing configurations may comprise at least one selected from a single row across the grid or matrix 105, one or more multiple rows across the grid or matrix 105 and a matched matrix to the preprinted grid pattern across the grid or matrix 105. As a result of firing the heated dots 52 in the firing configurations, that at least one overall image may be revealed on the reveal substrate 100.

In embodiments, the print head 12 may have one or more dots 52 on the face side 50 that are configured to provide at least one of heat, pressure and laser to activate the opaque coating or polymer material of the top layer 101 and/or change, transform or turn the opaque coating or polymer material to transparent, or at least substantially transparent, material thus revealing the colored dot, a portion of the matrix 105, color blocks 106 and/or print units 107 therebeneath.

In embodiments, the firing configurations determined and/or provided by the system 10 and/or the method 200 may comprise a plurality of firing configuration that may be base, at least in part, on the determined, identified and/or sensed alignment and/or misalignment of the reveal substrate 100 and the print head 12. For example, a first firing configuration may correspond to the determined, identified and/or sensed alignment of the reveal substrate and the print head 12. One or more second firing configuration may correspond to one or more determined, identified and/or sensed misalignments of the reveal substrate and the print head 12. Thus, if the reader 22 detects, determined, identifies and/or senses a misalignment based, at least in part, on the dots 56 and/or the registration image line 54, then the system 10 and/or method 200 may adjust, change, modify the first firing configuration to provide one or more second firing configurations which correctly align the reveal substrate 100 and the print head 12.

In embodiments, the system 10 and/or method 200 comprises at least one first print head 12 upstream with respect to reader 22 and at least one second print head 12 downstream with respect to reader 22 (not shown in the drawings). The system 10 and/or method 200 may provide a first firing configuration corresponding to alignment of the reveal substrate 100 and the at least one first print head 12. If alignment is determined, identified and/or sensed by the reader 22, the at least one second print head may be programmed with the first firing configuration for printing and/or imaging the at least one overall image onto the reveal substrate 100. As a result, the at least one second print head 12 will execute and/or perform the first firing configuration and the at least one overall image will be revealed on the reveal substrate 100 and be properly and/or correctly aligned thereon.

However, if misalignment of the reveal substrate 100 and the at least one first print head 12 is detected, determined, identified and/or sensed by the reader 22, then the system 10 and/or method 200 may determine, identify and/or provide at least one second firing configuration to the at least one second print head 12. As a result, the at least one second print head 12 may be programmed with the second firing configuration which corresponds to proper and/or correct alignment of the reveal substrate 100 and the at least one second print head 12. The difference between the first firing configuration and the at least one second firing configuration may be that different heated dots 52 may be fired such that the at least one second print head 12 and the reveal substrate 100 are properly and/or correctly aligned with respect to each other. In an embodiment, the at least one second firing configuration may comprise firing one or more different heated dots 52 that correct and/or compensate for the misalignment sensed between the at least one first print head 12 and the reveal substrate 100. The at least one second firing configuration may be a modification, change and/or adjustment of the first firing configuration that is based on the determined, sensed and/or identified misalignment of the at least one first print head 12 and the reveal substrate 100. The at least one second print head 12 may execute and/or perform the at least one second firing configuration to print and/or image the at least one overall image onto the reveal substrate 100. As a result of executing and/or performing the second firing configuration, the at least one overall image revealed onto the reveal substrate 100 may be properly and/or correctly aligned on the reveal substrate 100.

The revealed at least one overall image may be provided in a variety of one or more colors and/or one or more shades according to one or more colors of the CMYK color model or similar, as a result of correctly and accurately programming the print head 12, via the device 14, database 16 and/or the one or more novel color imaging software, to reveal particular color dots to form the desired at least one overall image.

In one or more alternative embodiments, present system 10 and/or method 200 may provide for a print substrate (i.e., bottom layer 102) which may be utilized to print or image in color using only one ink color or a sole ink color. Said print substrate comprises or consists of a substrate layer (i.e., bottom layer 102) having the colored areas 103, each of which comprises the matrix 105 formed by the color blocks 106, which may be arranged to have at least one repeating color pattern. In use, the print head 12 may apply an ink of a color which conceals a portion of the bottom layer 102 and leaves visible a second portion thereof, thereby creating the overall image perceivable by a viewer.

In another alternative embodiment, the top surface 104 of the bottom layer 102 may be provided free of the top layer 101 that has been described herein. This top layer free print substrate may be used to print in color using only one ink color or a sole ink color, such as, for example, white, black or another known color of a color model or color system. This present top layer free print substrate comprises or consists of the bottom layer 102 having the colored areas 103, each of which may comprise the matrix 105 formed by the color blocks 106, which may be arranged to have at least one repeating color pattern. In use, the print head 12 may apply an ink of a color or a sole ink color which conceals a first portion of the bottom layer 102 and leaves visible a second portion thereof, thereby creating an overall image to be perceivable by a view.

In yet another alternative embodiment, the present system 10 and/or method 200 may provide a print substrate comprising or consisting of a substrate layer similar to or same as the bottom layer 102 as described above, but instead is presented without the top layer 101 comprising the opaque polymer as described hereinabove. When using this type of print substrate (i.e. bottom layer 102 without top layer 101), the print head 12 does not apply heat or pressure, but rather the print head 12 may print with an opaque ink medium having a color to conceal portions of the print substrate (i.e., bottom layer 102). In an embodiment, the printed color may match or be similar to a base color of the print substrate (i.e., bottom layer 102). In an embodiment, the color of the ink medium may be, for example, white to ensure that there may be no color mixing with other colors present on the top surface 104 of the bottom layer 102.

In this alternative embodiment, the print head 12 may be programmed or programmable to print on only a first selected section of, or target locations on, the bottom layer 102 which may correspond in position to selected color blocks or portions thereof, causing only these target colors at the target locations to be concealed, which may leave visible only a desired second selected section of the bottom layer which form the overall image that is also not limited to a single block color, but rather can be a picture or a graphic, having a range of colors, color intensities and designs formed by the careful selection of the combination of colors from the color model and/or color system. In this manner, the print substrate (i.e., bottom layer 102 without top layer 101) may provide for the same range of customization and graphic capabilities as that of the reveal substrate 100 described herein.

Printing using said print substrate (i.e., bottom layer 102 without top layer 101) may be in principle inverse of that of the reveal substrate 100, because it may be printed by concealing previously visible colors on a bottom layer 102, while the reveal substrate 100 may be printed by revealing previously concealed colors on a bottom layer 102. Therefore, the said print substrate (i.e., bottom layer 102 without top layer 101) may be considered a "conceal substrate".

In a still further alternative embodiment, the present disclosure is directed to a method of color printing or imaging, comprising one or more the following steps of:

(a) programming the print head 12 to apply an opaque print medium to a first section of the top surface 104 of the bottom layer 102 that is free of the top layer 101 as described hereinabove; and (b) applying said opaque print medium to the first section of the top surface 104 of the substrate layer 102, thereby causing the first concealed section of the top surface 104 of the bottom layer 102 to become concealed by the applied opaque print medium, and leaving visible a revealed second section of the top surface of the substrate layer which is not concealed by the applied opaque print medium.

In embodiments, said revealed second section of the top surface 104 of the bottom layer 102 may correspond in position to selected color blocks 106, print units 107 and/or portions thereof present on the top surface 104 of the bottom layer 102. In an embodiment, the revealed second section may comprise one or more portions of the color grid and/or matrix 105. The selected color blocks 106, print units 107 and/or portions thereof left visible in said revealed second section of the top surface 104 of the bottom layer 102 in step (b) may be sufficiently or substantially small such that a human being perceives an image formed by said selected color blocks 106, print units 107 and/or portions thereof of the revealed second section of the top surface 104 of the bottom layer 102. In an embodiment, the reveal second section of the top surface 104 of the bottom layer 102 may form and/or provide the one or more image dots 56 and/or the registration image line 54 that may be sensed by the reader 22 during the present method 200 and/or if utilized with the present system 10.

FIG. 8 illustrates a flowchart of the method 200 for improving color imaging and alignment, registration and re-registration of the print head 12 and the reveal substrate 100. In embodiments, the method 200 may identifying the beginning of the color grid and/or the matrix 105 beneath opaque material of the top layer 101 of the reveal substrate 100 as shown at step 210. Further the method 200 may revealing at least one overall image on the reveal substrate 100 via the print head 12 that was programmed and/or programmable by the device 14, the database 16 and/or the one or more novel color imaging software as shown in step 220.

In embodiments, the method 200 may identifying color grid/matrix beginning beneath opaque layer of substrate by forming registration image line 54 and/or image dots 56 on the reveal substrate 100 via the heated dots 52 on the face side 50 of the print head 12 as shown at step 212. The method may read, inspect and/or record the registration image line 54 and/or image dots 56 via the reader 22, the device 14, the database 16 and/or the one or more novel color imaging software as shown in step 214. Moreover, the method 200 may determine the locations of underlying color grid and/or matrix 105 of the reveal substrate 100 and the print head 12 based, at least in part, on the read, inspected and/or recorded the registration image line 54 and/or image dots 56 via the reader 22, the device 14, the database 16 and/or the one or more novel color imaging software as shown in step 216.

In embodiments, the method 200 may revealing at least one overall image on substrate via programmed/programmable print head by firing at least one of heated, pressurized and/or laser dots 52 of print head 12 onto reveal substrate 100 in one or more firing configurations programmed and/or programmable via the reader 22, the device 14, the database 16 and/or the one or more novel color imaging software as shown in step 222.

In embodiments, the system 10 and/or method 200 may comprise the print head 12, reader 22, reveal substrate 100, and the one or more novel color imaging software (i.e., novel color image separation software, novel image pattern recognition software and/or novel dot reveal pattern software). The one or more novel color imaging software, when executed and/or performed by the system 10 and/or method 200, may coordinate, determine and/or provide the programmed and/or pre-defined dot reveal pattern instructions. Upon execution and/or performance of the programmed and/or pre-defined dot reveal pattern instructions, the system 10 and/or the method 200 may:

reveal underlying color dots, color blocks 106, print units 107 and/or portions thereof in at least one certain area of the reveal substrate 100;

determine at least one location of the print head 12 firing heated dots 52 with respect to the color pattern, grid and/or matrix 105 provided by the reveal substrate 100;

adjust firing instructions of the print head 12 based, at least in part, on said location to the programmed dot reveal pattern instructions;

fire the one or more appropriate heated dots 52 of the print head 12 to reveal selected one or more color blocks 106 and/or print units 107 on the reveal substrate 100;

periodically check the alignment of the reveal substrate 100 with respect to the print head 12 by using at least the reader 22, device 14, database 16 and/or the one or more novel color imaging software;

re-aligning the print head 12 and/or the reveal substrate 100 based, at least in part, on the checked alignment; and/or adjusting the dot firing instructions of the print head 12 based on said re-alignment and/or the checked alignment.

It will be appreciated that various of the above-disclosed and other features and functions, or alternatives thereof, may be desirably combined into many other different systems, methods and/or applications. Also, various presently unforeseen or unanticipated alternatives, modifications, variations or improvements therein may be subsequently made by those skilled in the art, and are also intended to be encompassed by the following claims.

The invention claimed is:

1. A system configured to improve imaging of a substrate, the system comprising:

a reveal substrate comprising:

a) an opaque polymer sensitive to at least one first application of at least one selected from heat, pressure and light, said opaque polymer becoming transparent upon being subjected to the at least one first application; and b) a bottom substrate layer having one or more colored areas on a top surface thereof, said bottom substrate layer being disposed such that the one or more colored areas are obscured by the opaque polymer prior to being subjected to the at least one first application and are revealed after at least one portion of the opaque polymer is subjected to the at least one first application;

a print head configured to apply the at least one first application to the at least one portion of the opaque polymer when the reveal substrate moves in a moving direction pass the print head such that the one or more colored areas beneath the at least one portion of the opaque polymer are revealed to provide one or more image dots of the reveal substrate;

an optical sensor positioned downstream with respect to print head in view of the moving direction of the reveal substrate, wherein the optical sensor is configured to sense the one or more image dots provided by the revealed one or more colored areas when the reveal substrate moves in the moving direction pass the optical sensor; and a computing and/or printing terminal in digital communication with the print head and the optical sensor and configured to determine alignment or misalignment of the reveal substrate and the print head based on the sensed one or more image dots provided by the revealed one or more colored areas of the reveal substrate.

2. The system according to claim 1, wherein:

each of the one or more colored areas comprises at least two different colors, and each of the one or more colored areas comprises a two-dimensional matrix formed by a plurality of color blocks, each one of the plurality of color blocks having only one of the at least two different colors, and the plurality of color blocks are arranged to have a repeating color pattern.

3. The system according to claim 2, wherein the plurality of color blocks overlap, forming overlapped areas which comprise a color formed from merging adjacent colors.

4. The system according to claim 1, wherein the print head has a face side, adjacent to the reveal substrate, comprising a plurality of firing dots for providing the one or more image dots, wherein each firing dot is configured or adapted to:

heat the at least one portion of the opaque polymer;

apply pressure onto the at least one portion of the opaque polymer; and/or emit light onto the at least one portion of the opaque polymer.

5. The system according to claim 1, wherein the print head is a thermal printing head having a plurality of firing dots on a face side adjacent to the reveal substrate, wherein each of the firing dots are configured or adapted to heat the at least one portion of the opaque polymer and/or apply pressure onto the at least one portion of the opaque polymer.

6. The system according to claim 1, wherein the one or more image dots provided by the revealed one or more colored areas form a registration image line extending along a portion of the reveal substrate that is indicative of the alignment or misalignment of the reveal substrate with respect to the print head.

7. The system according to claim 1, further comprising:

computer-instructions and/or software, when executed by the computing and/or printing terminal, determine alignment or misalignment of the reveal substrate and the print head based, at least in part, on the sensed one or more image dots provided by the revealed one or more colored areas of the reveal substrate.

8. The system according to claim 1, further comprising: an adhesive material applied to the reveal substrate.

9. A method for improving imaging of a printing process, the method comprising:

identifying a beginning of a color grid, provided on a top surface of a substrate and obscured by an opaque layer provided on the top surface of the substrate, by sensing one or more revealed image dots of the color grid, wherein the one or more revealed image dots are provided by at least one first application of at least one application selected from heat, pressure and light onto at least one first portion of the opaque layer covering the one or more revealed image dots such that said at least one first portion of the opaque layer becomes transparent to provide the one or more revealed image dots; and revealing at least one overall image on the substrate positioned thereon by a firing configuration that is based, at least in part, on the identified beginning of the color grid obscured by the opaque layer, wherein the firing configuration subjects at least one second portion of the opaque layer to at least one second application of at least one application selected from the heat, pressure and light such that said at least one second portion of the opaque layer becomes transparent to provide the revealed at least one overall image.

10. The method according to claim 9, wherein a print head subjects said first portion of the opaque layer to the at least one first application such that said first portion of the opaque layer becomes transparent, and wherein optionally, the print head is a thermal printing heat and the at least one first application consists of at least one application selected from heat and pressure, or optionally, one or more revealed image dots of the color grid are sensed by an optical sensor or reader located downstream with respect to the print head in view of a printing direction of the substrate.

11. The method according to claim 10, further comprising:

programming the print head with the firing configuration that is indicative of the at least one overall image and based on the identified beginning of the color grid.

12. The method according to claim 10, wherein the identified beginning of the color grid is sensed by an optical sensor or reader located downstream with respect to the print head in view of a printing direction of the substrate.

13. The method according to claim 10, further comprising:

sensing a registration image line provided by the one or more revealed image dots; and determining alignment or misalignment of the substrate and the print head based on the sensed registration image line.

14. A method for improving imaging of a printing or imaging process, the method comprising:

providing a bottom substrate layer having one or more colored areas on a top surface thereof, wherein the one or more colored areas on the top surface provide a color grid or matrix thereon;

applying, via a print head, an opaque print medium onto at least one first section of the top surface of the bottom substrate layer, as the bottom substrate layer moves in a printing direction of the printing or imaging process, such that the color grid or matrix provided at the at least one first section of the top surface is concealed by the applied opaque print medium and one or more second sections of the top surface remain visible so as to provide one or more visible image dots on the top surface of the bottom substrate layer sensing the one or more visible image dots via an optical sensor positioned downstream with respect to print head in view of the moving direction of the printing or imaging process; and determining alignment or misalignment of the bottom substrate layer and the print head based, at least in part, on the sensed one or more visible image dots provided by the one or more second sections of the top surface that remain visible after application of the opaque print medium.

15. The method according to claim 14, further comprising:

sensing, via the optical sensor, a registration image line formed or provided by the one or more visible image dots; and determining alignment or misalignment of the bottom substrate layer and the print head based, at least in part, on the sensed registration image line, and optionally, the opaque print medium consists of a sole or single ink color, preferably, the opaque print medium consists of white ink.

16. A method for improving imaging of a printing process, the method comprising:

determining a beginning of a color grid, provided on a top surface of a substrate and obscured by an opaque layer provided on the top surface of the substrate, is aligned with at least one print head, positioned downstream in a printing direction of the printing process, wherein the determined alignment is based, at least in part, on one or more revealed image dots sensed by at least one optical sensor located downstream with respect to the at least one print head in view of the printing direction of the print process, wherein the one or more revealed image dots are provided by at least one first application of at least one application selected from heat, pressure and light by the at least one print head onto at least one first portion of the opaque layer covering the one or more revealed image dots such that said at least one first portion of opaque layer becomes transparent to provide the one or more revealed image dots; and revealing at least one overall image on the substrate positioned thereon by a first firing configuration that is, at least in part, based on the determined alignment of the beginning of the color grid obscured by the opaque layer and the at least one print head, wherein the first firing configuration subjects at least one second portion of the opaque layer to at least one second application of at least one application selected from the heat, pressure and light by the at least one print head onto the at least one second portion of the opaque layer such that said at least one second portion of the opaque layer becomes transparent to provide the revealed at least one overall image.

17. The method according to claim 16, wherein the determined alignment is based on a registration image line, provided by the one or more revealed image dots, that is sensed by the optical sensor.

18. The method according to claim 16, further comprising:

subsequently determining alignment or misalignment of the substrate and the at least one print head based, at least in part, on at least one other revealed image dot of the substrate sensed by the optical sensor.

19. The method according to claim 18, further comprising:

re-aligning, when misalignment is subsequently determined, the at least one print head and the substrate based, at least in part, on the subsequently determined misalignment, wherein the re-aligning comprises determining, identifying or modifying the first firing configuration to provide a second firing configuration for the at least one print head.

20. The method according to claim 19, further comprising:

programming the at least one print head and/or at least one second print head to execute the second firing configuration that is based, at least in part, on said re-alignment and/or said subsequently determined misalignment, wherein the at least one second print head is positioned downstream with respect to the at least one print head and/or at least one optical sensor.

* * * * *